United States Patent [19]

Kobler

[11] Patent Number: 4,905,596

[45] Date of Patent: Mar. 6, 1990

[54] COMBINED CLEANING AND SAFETY DEVICE FOR PRINTING CYLINDER

[75] Inventor: Ingo Kobler, Anhausen, Fed. Rep. of Germany

[73] Assignee: Man Roland Druckmaschinen AG, Offenbach am Main, Fed. Rep. of Germany

[21] Appl. No.: 252,173

[22] Filed: Sep. 30, 1988

[30] Foreign Application Priority Data

Oct. 17, 1987 [DE] Fed. Rep. of Germany ..... 3735302

[51] Int. Cl.[4] ..... B41F 33/00; B41F 35/00

[52] U.S. Cl. ..... 101/216; 101/425

[58] Field of Search ..... 101/216, 425, 424, 423; 15/256.51

[56] References Cited

U.S. PATENT DOCUMENTS

| | | | |
|---|---|---|---|
| 1,196,438 | 8/1916 | Doyle et al. | 101/425 |
| 1,562,010 | 11/1925 | Stuke . | |
| 2,086,227 | 7/1937 | Huck | 101/425 |
| 2,704,026 | 3/1955 | Rogge | 101/137 |
| 2,961,953 | 11/1960 | Mosegaard | 101/425 |
| 3,508,711 | 4/1970 | Switall | 239/562 |
| 3,735,702 | 5/1973 | Kossak | 101/425 |
| 4,162,652 | 7/1979 | Rebel | 101/425 |
| 4,669,380 | 6/1987 | Seib et al. | 101/216 |
| 4,765,240 | 8/1988 | Kraus | 101/216 |

FOREIGN PATENT DOCUMENTS

| | | | |
|---|---|---|---|
| 1132151 | 6/1962 | Fed. Rep. of Germany . | |
| 3601539 | 7/1986 | Fed. Rep. of Germany . | |
| 1141751 | 9/1957 | France . | |
| 55871 | 4/1980 | Japan | 101/425 |
| 392326 | 5/1933 | United Kingdom | 101/425 |
| 747444 | 4/1956 | United Kingdom . | |

OTHER PUBLICATIONS

"Druck Print" 4/1975, pp. 198, 190, 192.

*Primary Examiner*—Clifford D. Crowder
*Attorney, Agent, or Firm*—Frishauf, Holtz, Goodman & Woodward

[57] ABSTRACT

To provide a cleaning arrangement which includes brushes brushing against the surface of a rubber blanket or other printing cylinder, to remove lint, dust, dirt and other contaminants therefrom a strip of brushes (9), preferably backed up by a suction pipe (8) to remove lint from the surface of the cylinder and from the brushes, is located inwardly of the finger guard strip (6) which is provided in advance of the nip between rotating cylinders as a safety measure. The cleaning elements, that is, brushes (9) and suction tubes (8), if provided, are located inwardly, with respect to the nip, of the safety guard or safety rail (6) which, typically, has angled or essentially in cross section part-circular, typically semi-circular shape. The safety guard is usually supported by levers (11) or slidably supported in the printing machine, to be placed out of position from the nip when the machine is stopped. The cleaning elements, that is brushes and suction tube, if provided, move with the safety rail to provide access to the nip between the cylinders when the machine is stopped. The cleaning structure does not require additional space or holding elements in the machine since the holders (11) for the safety guard rail (6) likewise support the cleaning elements (8, 9).

17 Claims, 2 Drawing Sheets

COMBINED CLEANING AND SAFETY DEVICE FOR PRINTING CYLINDER

REFERENCE TO RELATED PUBLICATIONS

German Patent Disclosure Document DE-OS No. 36 01 539.

Reference to related U.S. patent, assigned to the assignee of the present invention, the disclosure of which is hereby incorporated by reference: U.S. Pat. No. 4,765,240, Kraus et al., to which German Patent No. 36 10 697 corresponds.

The present invention relates to an apparatus to clean a cylinder in a rotary printing machine, and more particularly to remove lint or fluff which may collect on a rubber blanket cylinder of a rotary offset printing machine during operation of the printing machine.

BACKGROUND

It has previously been proposed, see German Patent Disclosure Document DE-OS No. 36 01 539, to provide an apparatus to clean an offset cylinder of a printing machine. Offset cylinders sometimes collect dust, lint, and the like during operation. In accordance with this disclosure, brushes are periodically engaged with the offset cylinder. Thus, lint and the like is swept off the engaged cylinder and directed to a lint collector. The brush is arranged at the periphery of the respective cylinder and secured at both ends in the side walls of the printing machine. It has been found that this placement and arrangement is inconvenient and interferes with work on the machine.

THE INVENTION

It is an object to provide an apparatus to clean a cylinder in a rotary printing press, and especially a rubber blanket cylinder of an offset printing press, which is so arranged that it does not require additional space and does not interfere during operation with the printing, nor does it interfere during stopping of the machine, for example for servicing or for other reasons, with access to the cylinder to be cleaned.

Briefly, an axially extendingn cleaning means is located ahead of the nip between the cylinder to be cleaned and an adjacent cylinder, for example immediately behind a protective safety shield or safety strip, which is required by safety regulations to be placed in advance of an essentially triangular entry zone between the cylinders, and ahead of the nip, to prevent injury, for example due to operator's fingers or clothing being caught by the cylinders. The holding structure for the safety guard and the cleaning means can be the same, thus saving on components and providing a combination unit.

The arrangement has the advantage that the cleaning element is located in a region which, during operation of the machine, is inaccessible to operators anyway, and, if the machine is stopped, can readily be removed from the specific location, since, to provide access, and when the machine is stopped, the safety guard rail or strip can also be removed from it.

DRAWINGS

Illustrating an embodiment of the invention:

FIG. 1 is a fragmentary side view of a printing machine side wall and a cylinder to be cleaned journalled in the side wall; and FIG. 2 is a side wall of the cylinder and illustrating the cleaning arrangement and, further, illustrating fragments of adjacent engaged cylinders.

DETAILED DESCRIPTION

Figure 1:
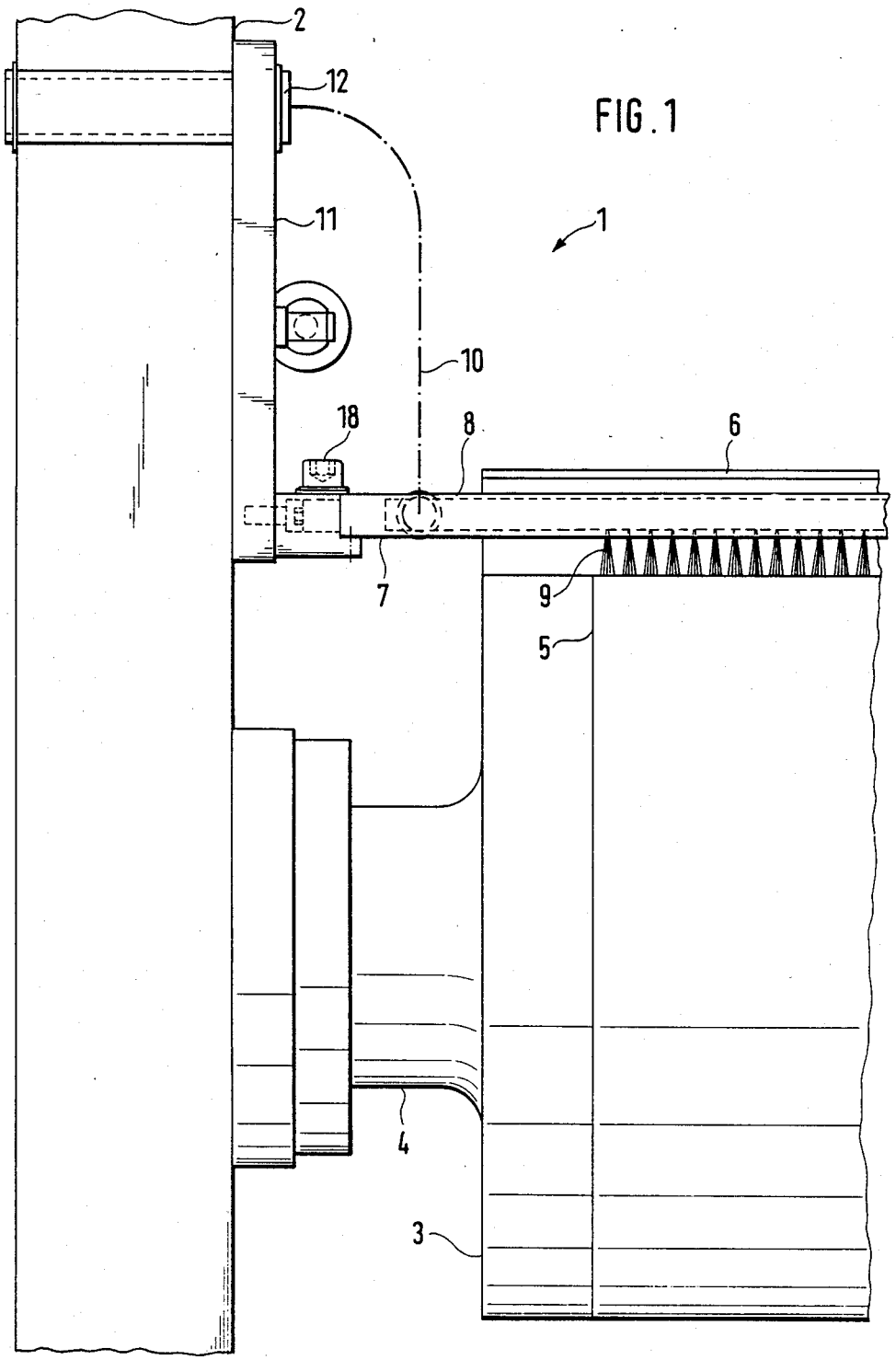

A rubber blanket cylinder 3 is located between a pair of side walls, only one of which is shown in FIG. 1. The arrangement can be mirror-symmetrical at the other side. The combination protective and cleaning apparatus 1 is likewise secured in the side wall 2—and at the other side in the mirror-symmetrical side wall, not shown, and can be respectively engaged and disengaged from the cylinder 3. Bearing pins 4 on the cylinder support the cylinder in the side wall. The construction of the combination protective and cleaning apparatus 1 can be similar, and mirror-symmetrical, or identical at the other side wall.

Figure 2:
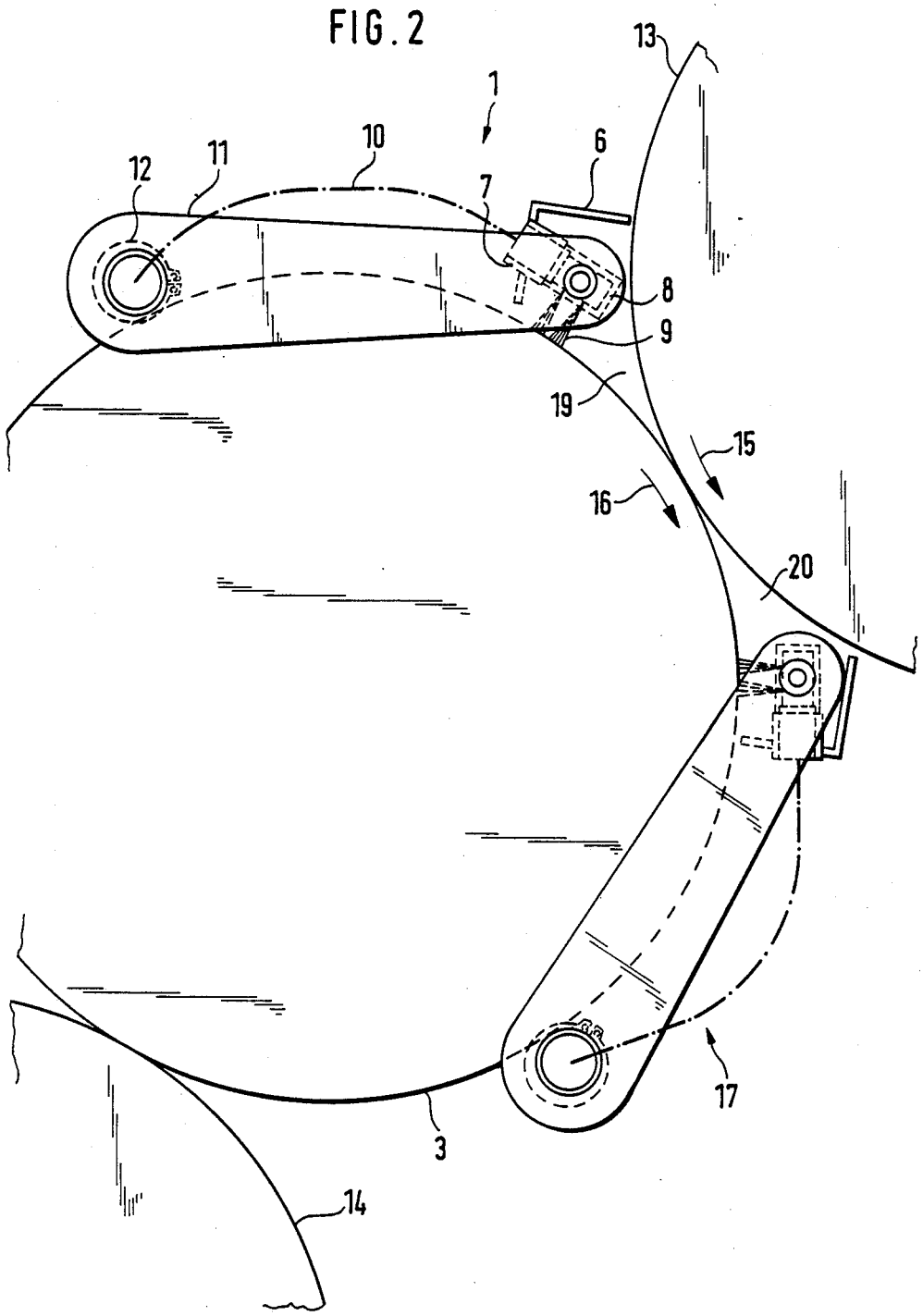

Various safety provisions require a finger or protective or security guide bar or strip in advance of the nip between a pair of rotating cylinders,see, for example, U.S. Pat. No. 4,765,240 , to prevent injuries to operators. Usually, such finger guards include a pivotable or slidable guard strip or rail 6 which, as shown in FIGS. 1 and 2, can be an angled rail element, a part-circular, for example essentially semi-circular (in cross section) rail or the like. The safety strip or rail 6 defines a concave surface, the hollow space of which faces the nip between the cylinders 3, 13. The protective strip or rail 6 is secured to a cross bar 7 which is indirectly retained between the side walls to be pivotable in and out of position in advance of the nip between a pair of cylinders.

In accordance with a feature of the present invention, a suction tube 8 is located on or within the cross bar or rod 7 with which dust, lint, dirt and other contaminants can be removed by suction. The lint, dust or dirt or contaminant is first removed from the cylinder to be cleaned by brushes 9, the suction tube 8 then removing the dirt, lint and the like from the brushes, or from their vicinity. The brushes remove the lint from a rubber blanket 5 (FIG. 1) on the cylinder 3.

The suction tube 8 is coupled to a flexible hose 10, shown only schematically in FIG. 1, which, in turn, is coupled to a suction device or source of vacuum through a coupling passing through the side wall 2 of the machine. The combination protective and cleaning device 1 can be simply placed in position or removed from protective position when the machine is stopped, which removal may be possible only when the machine is stopped due to interlocks, not shown, and as well known, by being secured to a pivotable lever 11 which is retained on the side wall on pivot joints 12. One end of the cross bar or rod 7 is, respectively, connected to each one of the levers 11, one on either side of the apparatus.

A second cylinder 13 is in engagement with the rubber blanket cylinder 3. The second cylinder 13, in dependence on the structure of the machine, may be an impression cylinder, a further rubber blanket cylinder or a plate cylinder. In the example selected, the cylinder 13 is a plate cylinder. Cylinder 3 is in engagement with yet another blanket cylinder 14 so that a web can be passed between the cylinders 13 and 14 for perfecting printing thereon. Of course, additional combination protective and cleaning apparatus can be associated with the cylinders 13, 14.

When the cylinders 3, 13 rotate in the direction of the arrows 15, 16, an entry zone 19 will be formed. This entry zone, which is essentially triangular, terminates in the nip between the cylinders. The cylinders can rotate in either direction and, if the cylinders rotate counter the direction of the arrows 15, 16, an entry zone 20 will be formed. To clean the cylinder 3 regardless of its direction of rotation, and to protect operators regardless of the direction of rotation of the cylinders, the protective and cleaning apparatus is provided twice, once at either side of the nip between the cylinders, as shown at 1 and 17, respectively.

In accordance with a feature of the invention, the combination cleaning and protecting apparatus 1, 17 is located in the region of the roughly triangular entry zones 19, 20, inwardly of the safety barrier or strip 6. This arrangement has the advantage that practically no additional space is required to place the cleaning apparatus. The presence of the cleaning apparatus does not interfere with work on the cylinders of the printing machine, when it is stopped. Since the protective strips or finger bars 6 are required anyway, the arrangement has the substantial advantage that those structural components needed to clean the cylinder can be so placed that they do not interfers with work on the cylinders and do not require additional space. They are located inwardly of the protective bars or strips. This has the additional advantage that the respective elements required to hold and adjust in position the protective strips as well as the cleaning elements are required only once, namely to hold both the protective strip and the cleaning apparatus. The protective strip 6 and the brushes can be adjusted, in common, for example by adjustment screws 18 (FIG. 1).

Rather than using brushes 9, other types of cleaning elements can be used. A suction device is preferred and desirable, but not absolutely necessary. The protective rails 6 can be made of angle elements, or part-circular, for example essentially semi-circular shaped strips. The levers 11 can be pivoted manually or, preferably, as well known,by using electrical, mechanical or fluid pressure operated devices. Likewise, the adjustment arrangement 18 can be electrically or mechanically operated or manually operated. Suitable interlocks - not shown— ensure that the levers 11 can be pivoted out of the protective position only when the machine is stopped.

Various changes and modifications may be made within the scope of the inventive concept.

I claim:

1. A printing machine having two cylinders (3, 13) which, in operation, are engaged towards each other and define a nip between said cylinders, and an essentially triangular entry zone (19, 20) adjacent the nip, said printing machine comprising the combination of a line removal and cleaning apparatus for continuously, during operation of the printing machine and rotation of the cylinders (3, 13), removing lint and for cleaning at least one of the cylinders with a protective safety strip (6) located in advance of said entry zone (19, 20);

wherein said protective safety strip comprises an axially extending element defining a concave surface and having lateral portions which, when the safety strip (6) is in position, are located close to the circumference of the cylinders (3, 13) to prevent accidental entry into said entry zone (19, 20) of an operator's fingers or of objects; and means (11) for retaining said safety strip (6) in position in advance of the nip when the machine is in operation, with said concave surface facing said nip;

wherein said lint removal and cleaning apparatus comprises an axially extending cleaning means (8, 9) located in said entry zone inwardly of said concave surface and coupled to the safety strip (6), whereby said lint removal and cleaning apparatus will be located between the safety strip and said nip.

2. The printing machine of claim 1, wherein said means (11) for retaining said safety strip (6) places the safety strip across said entry zone (19, 20); and wherein said cleaning means (8, 9) is supported from said safety strip retaining means (11) so that the retaining means conjointly supports the safety strip (6) and the cleaning means (8, 9), said safety strip being positioned with respect to the nip, outwardly of the cleaning means and covering the cleaning means.

3. The printing machine of claim 1, wherein the cleaning means comprises brushes (9).

4. The printing machine of claim 1, wherein the cleaning means comprises an axially extending suction device (8).

5. The printing machine of claim 4, further including a flexible suction hose coupled to said suction device (8).

6. The printing machine of claim 5, wherein the cleaning means comprises an axially extending suction device (8) and brushes (9) extending in the direction of the cylinder (3).

7. The printing machine of claim 1, wherein the cleaning means comprises an axially extending suction device (8) and brushes (9) extending in the direction of the cylinder (3).

8. The printing machine of claim 7, wherein the cleaning means comprises an axially extending suction device (8) and brushes extending in the direction of the cylinder (3).

9. The printing machine of claim 1, wherein the safety strip retaining means comprises support levers (11) pivotably secured to said side walls (2) of the machine supporting the safety strip (6);

and wherein said cleaning means (8, 9) extends axially across the cylinder and is secured to said levers (11).

10. The printing machine of claim 9, wherein the cleaning means comprises brushes (9).

11. The printing machine of claim 9, wherein the cleaning means comprises an axially extending suction device (8).

12. The printing machine of claim 9, wherein the cleaning means comprises an axially extending suction device (8) and brushes (9) extending in the direction of the cylinder (3).

13. The printing machine of claim 1, wherein the direction of rotation of said cylinder and said at least one further cylinder is reversible so that, in dependence on the direction of rotation of said cylinders, respective entry zones (19, 20) will be formed at either side of the nip;

and wherein a safety strip and an axially extending cleaning means coupled to the safety strip are located in both of said entry zones.

14. The printing machine of claim 13 wherein said means (11) for retaining each of said safety strips (6) places the safety strip across said entry zones; and wherein each of said cleaning means (8, 9) is supported from said safety strip retaining means (11) so that the retaining means conjointly supports the safety strip (6) and the cleaning means (8, 9), said safety strip being positioned, with respect to the nip, outwardly of the cleaning means and covering the cleaning means.

15. The printing machine of claim 13, wherein each of said cleaning means comprises an axially extending suction device (8) and brushes (9) extending in the direction of the cylinder (3).

16. The printing machine of claim 13 wherein the safety strip retaining means comprises support levers (11) pivotably secured to the side walls of the machine supporting each of said safety strips (6);

and wherein each of said cleaning means (8, 9) extends axially across the cylinder and is secured to respective levers (11).

17. The apparatus of claim 1, wherein said cleaning means comprises at least one of:

an axially extending suction device (8);

brushes (9) extending in the direction of said at least one cylinder.

* * * * *